US011731253B2

(12) United States Patent
Seith et al.

(10) Patent No.: US 11,731,253 B2
(45) **Date of Patent: *Aug. 22, 2023**

(54) IMPACT TOOL ANGULAR VELOCITY MEASUREMENT SYSTEM

(71) Applicant: Ingersoll-Rand industrial U.S., Inc., Davidson, NC (US)

(72) Inventors: Warren A. Seith, Bethlehem, PA (US); Jason D. Urban, Kintnersville, PA (US); Douglas E. Pyles, Bethlehem, PA (US); Mark T. McClung, Andover, NJ (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/410,726

(22) Filed: Aug. 24, 2021

(65) Prior Publication Data

US 2021/0379744 A1 Dec. 9, 2021

Related U.S. Application Data

(63) Continuation of application No. 15/664,577, filed on Jul. 31, 2017, now Pat. No. 11,097,405.

(51) Int. Cl.
*B25B 23/147* (2006.01)
*B25B 21/02* (2006.01)

(52) U.S. Cl.
CPC ..... *B25B 23/1475* (2013.01); *B25B 21/02* (2013.01); *B25B 21/026* (2013.01)

(58) Field of Classification Search
CPC ..... B25B 21/02; B25B 23/147; B25B 21/026; B25B 23/1475; B25B 23/1405; B25B 23/14; B25B 21/008
(Continued)

(56) References Cited

U.S. PATENT DOCUMENTS 4,609,089 A * 9/1986 Kobayashi ..... B25B 23/1453 173/183
6,371,218 B1 4/2002 Amano et al.
(Continued)

FOREIGN PATENT DOCUMENTS

DE 102014116032 A1 5/2016
WO 02083366 A1 10/2002

OTHER PUBLICATIONS

Extended Search Report for European Application No. 18186687.2, dated Jan. 4, 2019.

*Primary Examiner* — Andrew M Tecco
*Assistant Examiner* — Jacob A Smith
(74) *Attorney, Agent, or Firm* — Kevin E. West; Advent, LLP

(57) ABSTRACT

An impact tool is provided which includes a drive source configured to rotate an output drive. A hammer is movable in a first direction to apply a rotational impact force on an anvil which rotates the output drive. A first hammer angle sensor set to a first signal channel and located proximate to a surface of the hammer. A plurality of regularly spaced targets are located on the surface of the hammer. Each of the plurality of regularly spaced targets are detectable by the first hammer sensor. And detection of one or more of the plurality of regularly spaced targets by the first hammer sensor indicates movement of the hammer.

17 Claims, 5 Drawing Sheets

(58) Field of Classification Search
USPC ..... 173/1, 2, 176, 181, 93
See application file for complete search history.

(56) References Cited

U.S. PATENT DOCUMENTS

| | | | |
|---|---|---|---|
| 6,508,313 | B1 | 1/2003 | Carney et al. |
| 6,598,684 | B2 | 7/2003 | Watanabe |
| 6,607,041 | B2 | 8/2003 | Suzuki et al. |
| 6,868,742 | B2 | 3/2005 | Schoeps |
| 7,011,000 | B2 | 3/2006 | Kushida et al. |
| 7,275,450 | B2 | 10/2007 | Hirai et al. |
| 7,453,225 | B2 | 11/2008 | Friberg |
| 7,556,103 | B2 | 7/2009 | Matsunaga |
| 7,650,791 | B2 | 1/2010 | Cioto et al. |
| 7,708,085 | B2 | 5/2010 | DeCicco et al. |
| 7,735,398 | B2 | 6/2010 | Hsu et al. |
| 7,757,587 | B2 | 7/2010 | Kaneyama et al. |
| 7,823,486 | B2 | 11/2010 | Wise |
| 8,104,546 | B2 | 1/2012 | Aeberhard |
| 8,851,201 | B2 | 10/2014 | Limberg et al. |
| 8,881,842 | B2 | 11/2014 | Borinato et al. |
| 8,919,456 | B2 | 12/2014 | Ng et al. |
| 8,985,241 | B2 | 3/2015 | Pozgay et al. |
| 8,991,518 | B2 | 3/2015 | Elsmark |
| 9,038,743 | B2 | 5/2015 | Aoki |
| 9,149,917 | B2 | 10/2015 | Beer et al. |
| 9,193,055 | B2 | 11/2015 | Lim et al. |
| 9,233,457 | B2 | 1/2016 | Wanek et al. |
| 9,261,420 | B2 | 2/2016 | Lee et al. |
| 9,296,095 | B2 | 3/2016 | Yoshino et al. |
| 9,352,456 | B2 | 5/2016 | Murthy et al. |
| 10,124,474 | B2 | 11/2018 | Mayer et al. |
| 2009/0071671 | A1* | 3/2009 | Zhong ..... B25F 5/001 173/176 |
| 2009/0250233 | A1* | 10/2009 | Wallace ..... B25B 23/1405 173/183 |
| 2010/0263890 | A1 | 10/2010 | Profunser et al. |
| 2012/0222876 | A1* | 9/2012 | Schmidt ..... B25B 31/00 173/179 |
| 2012/0279362 | A1 | 11/2012 | Cummings et al. |
| 2013/0007512 | A1 | 1/2013 | Amin et al. |
| 2013/0228353 | A1 | 9/2013 | Chen et al. |
| 2013/0333910 | A1* | 12/2013 | Tanimoto ..... B25B 23/1475 173/176 |
| 2014/0158390 | A1 | 6/2014 | Mashiko et al. |
| 2014/0338939 | A1 | 11/2014 | Shi |
| 2014/0367134 | A1 | 12/2014 | Phillips et al. |
| 2015/0014010 | A1 | 1/2015 | Chang |
| 2015/0021062 | A1 | 1/2015 | Sekino et al. |
| 2015/0041163 | A1* | 2/2015 | McClung ..... B25B 21/02 173/176 |
| 2015/0216220 | A1 | 8/2015 | Rich et al. |
| 2015/0231771 | A1 | 8/2015 | Sakai et al. |
| 2015/0266170 | A1 | 9/2015 | Weller |
| 2015/0336248 | A1 | 11/2015 | Goe |
| 2015/0336249 | A1 | 11/2015 | Iwata et al. |
| 2015/0352698 | A1 | 12/2015 | Hsu |
| 2015/0352699 | A1 | 12/2015 | Sakai et al. |
| 2016/0121467 | A1 | 5/2016 | Ng et al. |
| 2016/0207180 | A1 | 7/2016 | Hohmann et al. |
| 2016/0229037 | A1 | 8/2016 | Quigley |
| 2016/0325415 | A1* | 11/2016 | Huber ..... B25B 23/18 |
| 2017/0057064 | A1 | 3/2017 | Ishikawa et al. |
| 2017/0144278 | A1 | 5/2017 | Nishikawa et al. |
| 2017/0197302 | A1 | 7/2017 | Kobayashi |
| 2017/0199509 | A1 | 7/2017 | Khalaf |
| 2017/0246732 | A1 | 8/2017 | Dey, IV et al. |

* cited by examiner

IMPACT TOOL ANGULAR VELOCITY MEASUREMENT SYSTEM

TECHNICAL FIELD AND SUMMARY

The present disclosure relates, generally, to impact tools and, more particularly, to a mechanism that measures the angular velocity of components in the impact tool.

An illustrative embodiment of the present disclosure provides an impact tool which comprises: an impact force generation unit that includes a hammer that is movable in a first direction and which applies a rotational impact force on an anvil that rotates the output drive; a first hammer angle sensor set to a first signal channel and located proximate to a surface of the hammer, and a second hammer angle sensor set to a second signal channel and located proximate to the surface of the hammer and adjacent to first hammer angle sensor; a plurality of regularly spaced targets located on the surface of the hammer; wherein each of the plurality of regularly spaced targets are detectable by the first and second hammer sensors; wherein detection of one or more of the plurality of regularly spaced targets by the first and second hammer sensors indicates movement of the hammer; a first anvil angle sensor set to a third signal channel and located proximate to a surface of the anvil, and a second anvil angle sensor set to a fourth signal channel and located proximate to the surface of the anvil and adjacent to first anvil angle sensor; a plurality of regularly spaced targets located on the surface of the anvil; wherein each of the plurality of regularly spaced targets on the anvil are detectable by the first and second anvil sensors; wherein detection of one or more of the plurality of regularly spaced targets on the anvil by the first and second anvil sensors indicates movement of the anvil that resulted from an impact force created when the hammer struck the anvil; and a controller that receives and processes a plurality of signals generated by the first and second hammer angle sensors and the first and second anvil angle sensors.

Another illustrative embodiment of the present disclosure provides an impact tool which comprises: a drive source configured to rotate an output drive; an impact force generation unit that includes a hammer that is movable in a first direction to apply a rotational impact force on an anvil which rotates the output drive; a first hammer angle sensor set to a first signal channel located proximate to a surface of the hammer, and a second hammer angle sensor set to a second signal channel also located proximate to the surface of the hammer and adjacent to first hammer angle sensor; a plurality of regularly spaced targets located on the surface of the hammer; wherein each of the plurality of regularly spaced targets are detectable by the first and second hammer sensors; wherein detection of one or more of the plurality of regularly spaced targets by the first and second hammer sensors indicates rotation of the hammer; and a controller configured to receive and process a plurality of signals generated by the first and second hammer angle sensors to determine the angular velocity of the output drive.

In the above and other illustrative embodiments, the impact tool may further include any one or more of the following: the first and second hammer sensors being configured to detect movement of the hammer in a second direction opposite the first direction after the hammer impacts the anvil; an anvil angle sensor and a plurality of regularly spaced anvil targets mounted on a surface of the anvil; the anvil angle sensor being located proximate to the surface of the anvil, wherein each of the plurality of regularly spaced anvil targets are detectable by the anvil angle sensor, and wherein the controller being configured to receive and process a plurality of signals also generated by the anvil angle sensor to determine the angular velocity of the output drive; a three axis gyroscopic sensor mounted within a tool housing portion of the impact tool, wherein the three axis gyroscopic sensor detects housing rotation about an axis coincident with an axis of rotation of the output drive, and wherein the controller being configured to receive gyroscopic signals to assist in determining the angular velocity of the output drive; the each of the plurality of regularly spaced targets is selected from the group consisting of a plurality of ferromagnetic markings, capacitive markings, optical markings, and physically or electronically perceptible markings; an accelerometer that sends a signal to the controller to detect an impact between the hammer and anvil; a motor sensor that sends a signal to the controller to detect motor output torque; a transmitter that wirelessly transmits signal from the impact tool; data storage to store data received by the controller; a selector switch for setting socket size; at least one strain gage on the anvil to measure the torque generated by the anvil; and an at least 20 amp lithium battery.

An illustrative embodiment of the present disclosure provides an impact tool which comprises: a drive source configured to rotate an output drive; a hammer that is movable in a first direction to apply a rotational impact force on an anvil which rotates the output drive; a first hammer angle sensor set to a first signal channel and located proximate to a surface of the hammer; a plurality of regularly spaced targets located on the surface of the hammer; wherein each of the plurality of regularly spaced targets are detectable by the first hammer sensor; and wherein detection of one or more of the plurality of regularly spaced targets by the first hammer sensor indicates movement of the hammer.

In the above and other illustrative embodiments, the impact tool may further include any one or more of the following: a controller configured to receive and process a plurality of signals generated by the first hammer angle sensor to determine the angular velocity of the hammer; a second hammer angle sensor set to a second signal channel also located proximate to the surface of the hammer and adjacent to first hammer angle sensor; the first and second hammer sensors being configured to detect rotation of the hammer in a second direction opposite the first direction after the hammer impacts the anvil; an anvil angle sensor and a plurality of regularly spaced anvil targets mounted on a surface of the anvil; the anvil angle sensor is located proximate to the surface of the anvil, wherein each of the plurality of regularly spaced anvil targets being detectable by the anvil angle sensor, and wherein the controller is configured to receive and process a plurality of signals also generated by the anvil angle sensor to determine the angle and velocity of the output drive; and a three axis gyroscopic sensor mounted within a tool housing portion of the impact tool, wherein the three axis gyroscopic sensor detects housing rotation about an axis coincident with an axis of rotation of the output drive, and the controller being configured to receive gyroscopic signals to assist in determining the angle and velocity of the output drive.

Additional features and advantages of the impact tool angular velocity measurement mechanism will become apparent to those skilled in the art upon consideration of the following detailed description of the illustrated embodiments exemplifying best modes of carrying out the impact tool angular velocity measurement mechanism as presently perceived.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity.

Figure 1:
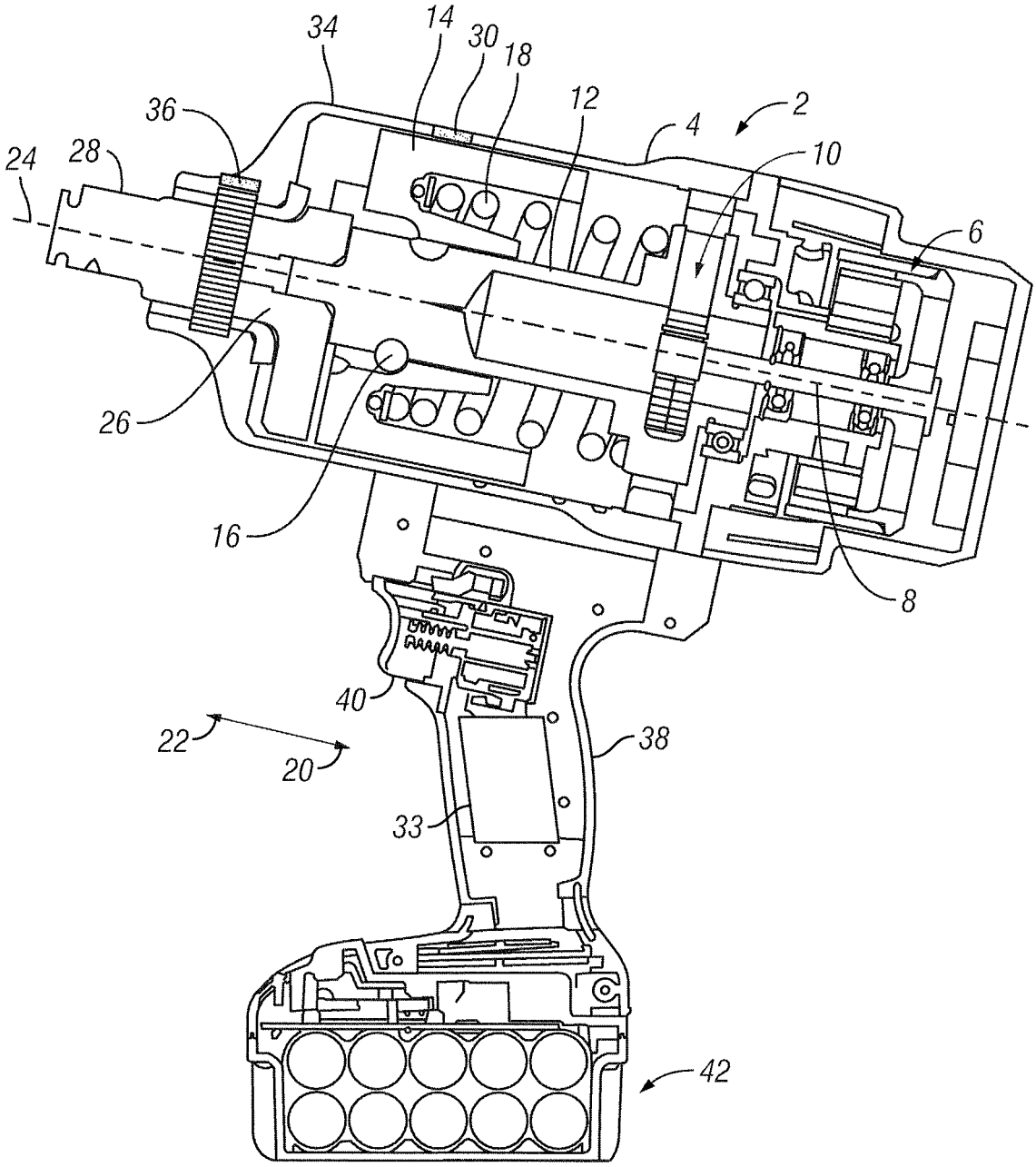
FIG. 1 is a cross-sectional view of an illustrative embodiment of an impact tool.

Corresponding reference characters indicate corresponding parts throughout the several views. The exemplification set out herein illustrates embodiments of the impact tool angular velocity measurement mechanism, and such exemplification is not to be construed as limiting the scope of the impact tool angular velocity measurement mechanism in any manner.

DETAILED DESCRIPTION OF THE DRAWINGS

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

An illustrative embodiment of the present disclosure provides electronic detectors, encoders, or sensors (referred to general as detectors) added to at least the hammer, and a controller to monitor the function of an impact wrench. In another embodiment the detectors are added to both the hammer and the anvil. These detectors monitor anvil rotation and hammer velocity. These signals are processed by a controller which determines the incremental bolt angle that occurs during each impact between the hammer and anvil. The controller then calculates the quantity of energy that has been delivered to the fastener.

An embodiment of the angular velocity measurement mechanism may include, but is not limited to, one or more of the following features: measuring the forward hammer velocity just prior to impact between the hammer and anvil and reverse velocity immediately after impact between the hammer and anvil to determine the amount of energy that left the tool during impact; measuring the sudden change of rate of angular velocity of the anvil used to detect when an impact between the hammer and anvil has occurred; measuring the incremental anvil angle associated with a single impact between the hammer and anvil to determine the fastener or bolt rotation from that impact; and measuring the cumulative anvil angle used during a fastening cycle to determine total angle the fastener or bolt was rotated.

Using a hammer encoder signal generated by the detectors directed to the hammer, the controller calculates hammer velocity before and after each impact between the hammer and anvil. Given the rotational velocity of the hammer, and the rotational inertia of the hammer, it is possible to calculate the angular kinetic energy in the hammer illustratively by the formula one-half multiplied by the angular velocity multiplied by the moment of inertia squared (i.e., $\frac{1}{2}Iw^2$). These velocity measurements may then be used to determine how much energy has left the impact mechanism and transmitted forward into the socket.

The angle of rotation of the fastener or bolt may be determined by measuring the angle of rotation of the impact tool's anvil. Since the tool anvil and bolt head are directly connected by the socket, the angle of rotation of the bolt should be substantially the same as that of the anvil. Using an anvil angle encoder signal generated by the detector, the controller may calculate both the incremental angle that occurs during each impact, and the cumulative angle of anvil rotation of the bolt.

A cross-sectional view of an illustrative embodiment of an impact tool 2 is shown in FIG. 1. This view of impact tool 2 includes housing 4 that contains motor 6 that drives a rotating rod 8 which drives gear set assembly 10. Illustratively, gear set assembly 10 rotates cam shaft 12. This rotates hammer 14 via cam ball 16 which engages both cam shaft 12 and hammer 14. Rotating hammer 14 draws it against the bias of spring 18 illustratively in direction 20 until hammer 14 is released moving it in direction 22 as well as rotates about an axis 24. Hammer 14 impacts anvil 26 causing same to rotate. Continuing this process causes hammer 14 to create continuous intermittent impacts against anvil 26 causing it to continually rotate. Output drive 28 extends from anvil 26 and can receive a connector or other device that engages a fastener or bolt to tighten or loosen same.

Aspects of the present disclose may be included on impact tools of the type disclosed in U.S. Pat. No. 9,597,784, "Impact tools", issued Mar. 21, 2017; U.S. Pat. No. 9,592,600 "Angle impact tools" issued Mar. 14, 2017; U.S. Pat. No. 9,573,254, "Impact tools", Feb. 21, 2017; U.S. Pat. No. 9,555,532, "Rotary Impact Tool", issued Jan. 31, 2017; U.S. Pat. No. 9,550,284 "Angle Impact Tool", issued Jan. 24, 2017; U.S. Pat. No. 9,486,908, ", "Rotary Impact Tool", issued Nov. 8, 2016; U.S. Pat. No. 9,272,400, "Torque-limited Impact Tool", issued Mar. 1, 2016; U.S. Pat. No. 9,022,888, "Angle Impact Tool", issued May 5, 2015; U.S. Pat. No. 8,925,646, "Right Angle Impact Tool" issued Jan. 6, 2015; U.S. Pat. No. 7,673,702, "Impact wrench", issued Mar. 9, 2010; and U.S. Pat. No. 7,562,720, "Electric motor impact tool", issued Jul. 21, 2009. The disclosures of which, including their structures and mechanisms of operation, are herein incorporated by reference. It will be appreciated by the skilled artisan upon reading this disclosure that the foregoing incorporated impact tool references can be used in the present disclosure. The common thread is the rotating hammer striking the anvil. It is further appreciated any other mechanism that produces the rotating hammer and anvil mechanism is intended to be included herein and is part of the scope of this disclosure.

As part of impact tool 2, a plurality of detectors such as detector 30 shown in FIG. 1 (see, also, detector 32 in FIGS. 2 and 3) is attached to hammer case portion 34 of housing 4 of impact tool 2. It is appreciated that hammer case portion 34 may either be a separate structure or an integrally formed part of housing 4. Detector 30 is intended to be located in proximity to hammer 14. Illustratively, such detectors or sensors may be rotary, incremental, shaft and/or quadrature encoders. In the illustrative embodiment, two encoders (such as detectors 30 and 32) may be used, each having a unique channel output. Each encoder transmits pulses when the hammer is moving. Using an encoder with two channels allows not only measures position of the hammer but also direction and speed. For purposes of this disclosure these encoders, sensors, etc., will be herein generally referred to as detector. It will be appreciated by the skilled artisan upon reading this disclosure that illustratively, the encoders for the hammer and anvil may operate the same. Each of these encoders may have a minimum of two channels, as needed, to determine direction of rotation. These channels are phase shifted from each other by 90 degrees. In other illustrative embodiments, the encoders may be replaced with resolvers. A two channel resolver may operate similar to an encoder, except the output from each sensor is an analog signal instead of digital signal.

Similarly, in an illustrative embodiment, another detector set 36 and 37 may be attached to hammer case 34 or like structure. Detectors 36 and 37 are located in proximity of a portion of anvil 26 (see, also, FIG. 3). In this illustrative embodiment, and as will be discussed in more detail herein, detectors 36 and 37 are configured to detect the angular movement of anvil 26. It will be appreciated by the skilled artisan upon reading this disclosure that detectors 30, 32, 36, and 37 may be electrically connected to a controller 33.

Also shown in FIG. 1 is handle assembly 38. Trigger 40, part of handle assembly 38, actuates motor 6 in order to rotate output drive 28. Controller 33, in one embodiment may be located onboard impact tool 2 in handle assembly 38. In another embodiment, controller 33 may be located remotely from impact tool 2. A power supply 42 may be attached to handle assembly 38 to supply power to motor 6 and any other electrical systems onboard impact tool 2. Illustratively, power supply 42 may be a 20-amp or greater lithium battery, for example, to provide sufficient power to the power tool 2. In other embodiments, impact tool 2 may be supplied with power via a power supply cord also connected to a power supply outlet or other power source.

Figure 2:
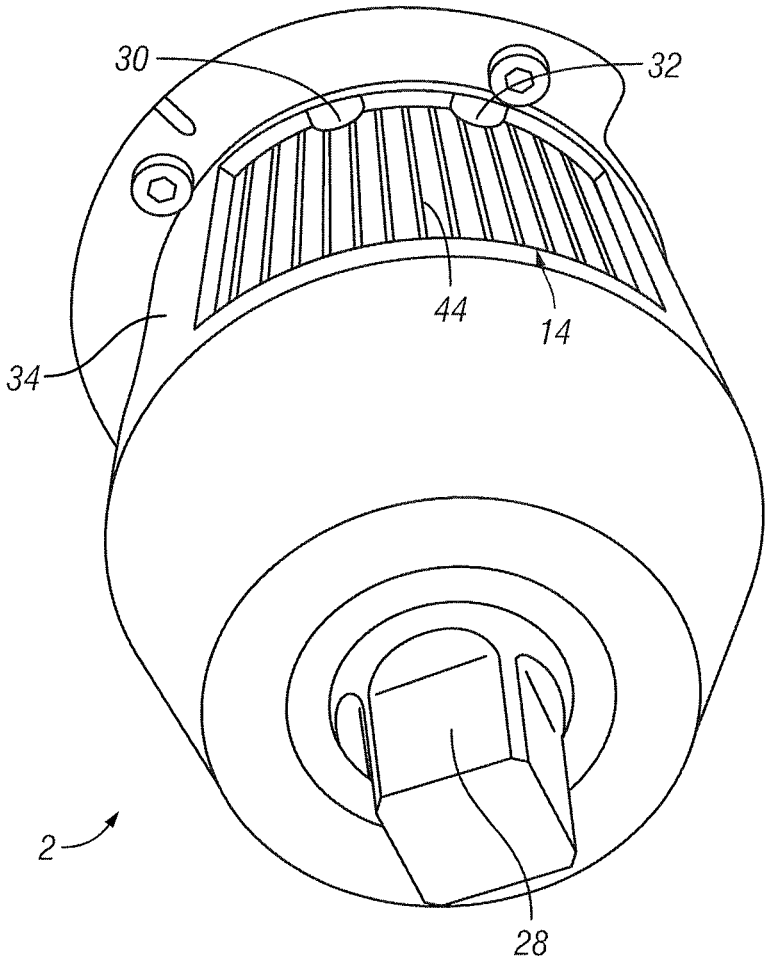
FIG. 2 is a front perspective view of the impact tool.

A front perspective view of impact tool 2 with a portion of its hammer case 34 removed is shown in FIG. 2. This view depicts how detectors 30 and 32 are illustratively positioned relative to each other and to hammer 14. A plurality of markings 44 such as line markers or other indicia on hammer 14 may be read or otherwise detected by detectors 30 and 32 in order to read the positioning of hammer 14. Illustratively, each detector is electrically phase shifted from each other defining different channels as previously discussed. In this way, the detectors can determine in which direction hammer 14 is travelling and at what speed. These measurements may then be used to determine the amount of energy that may be delivered to the fastener that is being rotated by output drive 28.

Figure 3:
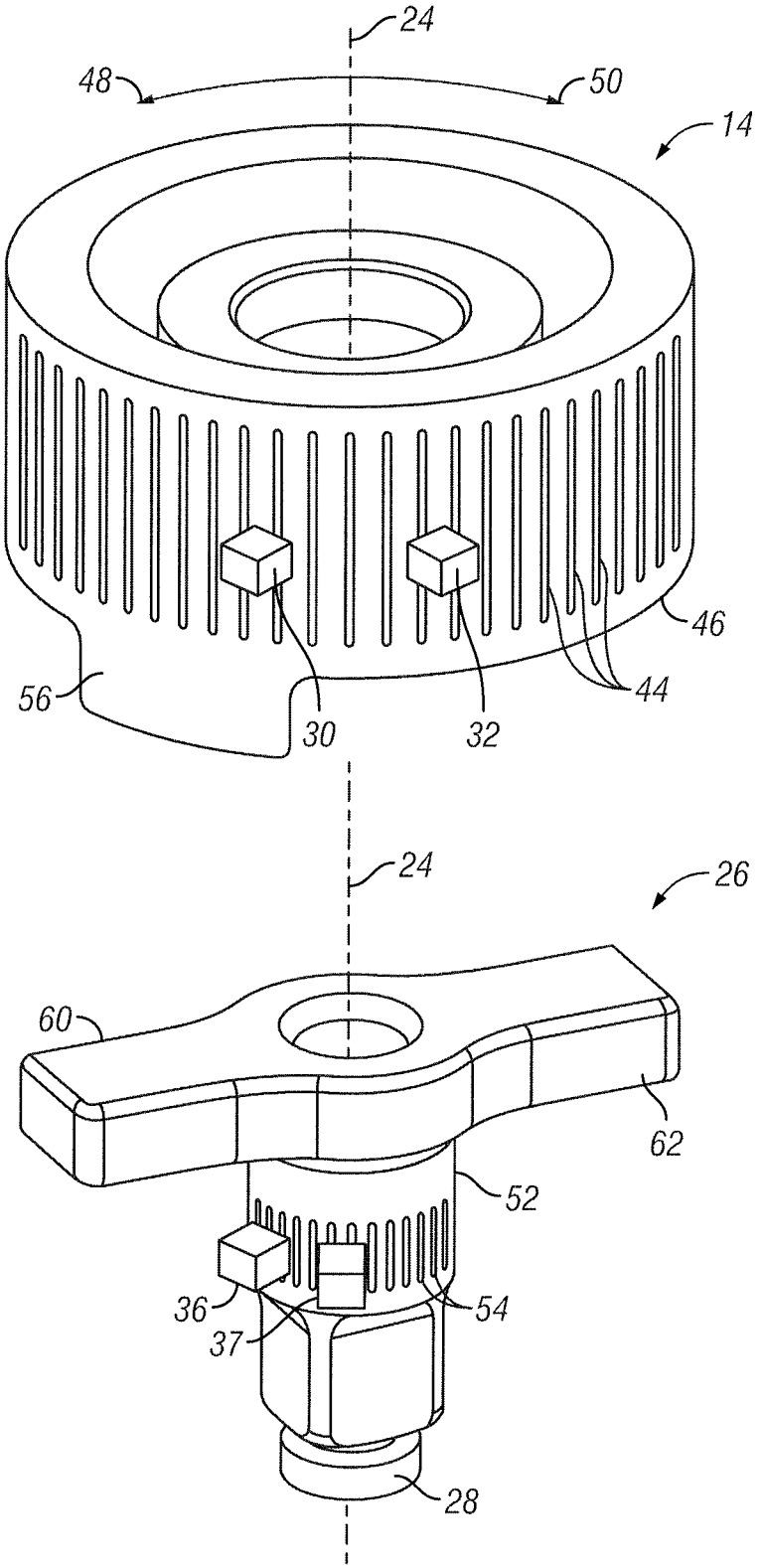
FIG. 3 is an isolated exploded view of the hammer and anvil portions of the impact tool.

An isolated exploded view of hammer 14 and anvil 26 are shown in FIG. 3. Also depicted in this view are detectors 30, 32 located in proximity of hammer 14 and detectors 36 and 37 located in proximity of anvil 26. Markings such as encoder lines 44 are regularly spaced about outer surface 46 of hammer 14 as illustratively shown. It will be appreciated by the skilled artisan upon reading this disclosure that such lines 44 may be placed on surface 46 in any variety of ways that allow detectors 30 and 32 to detect them. For example, lines 44 may be cut or scribed into surface 46, or may be cut into surface 46 and filled with ink or a magnetic material readable by certain detectors. Alternatively, lines 44 may take the form of an optically readable characteristic for certain detectors. One skilled in the art will recognize that any such variety of known readable markings may be placed on hammer 14. All that is necessary is that the markings have characteristics that can be detected by the detector. As such, the two detectors 30 and 32 are phase shifted from each other and are able to detect the markings. The will be able to detect whether hammer 14 is rotating in either direction 48 or 50. Accordingly, by embedding or otherwise placing the detectors on hammer case 34 or other location in proximity of hammer 14 sufficient to detect movement of same, detectors 30 and 32 with lines 44 or other markings, structures, or indicia, may detect the angular or rotational movement of hammer 14 in either direction.

Similarly, surface 52 of anvil 26 includes a plurality of markings 54 that are regularly spaced thereabout and configured to be read by detectors 36 and 37 are illustratively composed of two channels. Detectors 36 and 37 may operate similar to that described with respect to detectors 30 and 32. In some illustrative embodiments, anvil 26 may be extended either axially or radially to accommodate the markings, and to ensure sufficient proximity between surface 52 and detectors 36 and 37.

Figure 6:
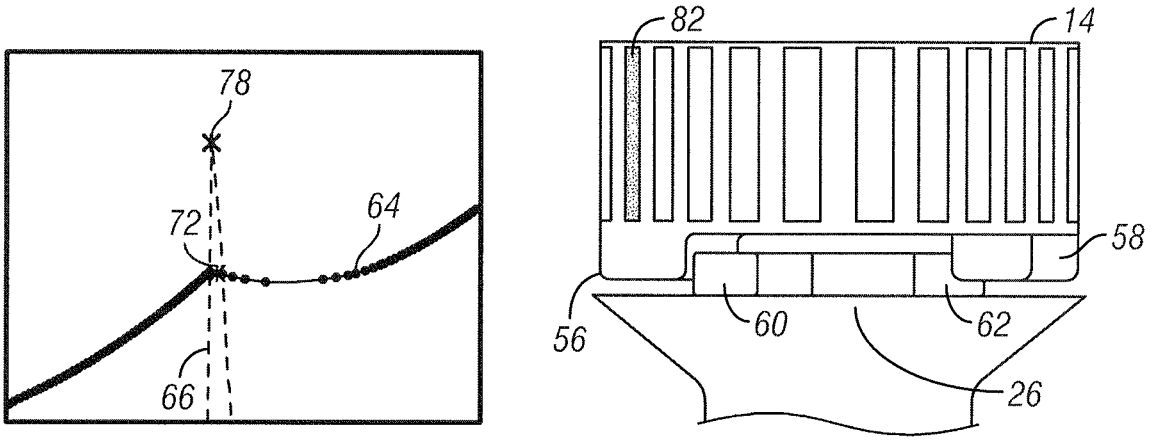
FIG. 6 is another a portion of the isolated detailed progression view of the hammer and anvil along with an isolated portion of the chart of FIG. 4.
Figure 7:
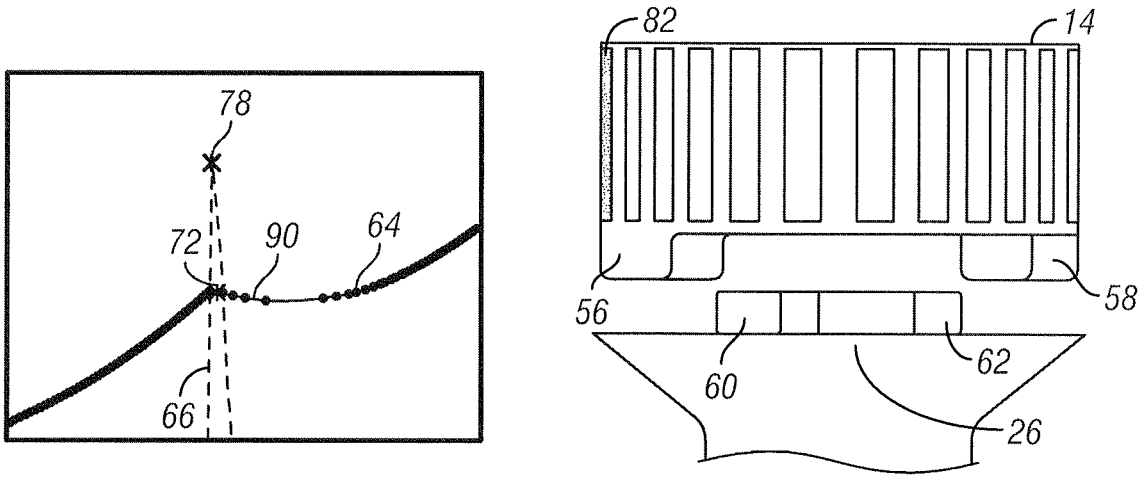
FIG. 7 is a another a portion of the isolated detailed progression view of the hammer and anvil along with an isolated portion of the chart of FIG. 4.

It is also illustratively shown in FIG. 3 that hammer 14 includes jaws 56 (jaws 58 is shown in FIGS. 6 and 7) which is configured to strike either of flanges 60 or 62 on anvil 26. Accordingly, as hammer 14 rotates, the amount of that rotation is being detected by detectors 30 and 32. As jaws 56 (as well as head 58) strike either of flanges 60 and 62, anvil 26 is caused to rotate as well. Detectors 36 and 37 measure the angle of rotation of anvil 26 based on how many markings 54 are read. The net effect of this is that the controller can receive data about how much the hammer is rotating, and how much the anvil is rotating in response to being struck by the hammer.

It is further appreciated that impact tool 2 may include a three axis gyroscopic sensor located thereon. This sensor measures the rotation of the housing about axis 24. Illustratively, the three axis gyroscopic sensor may be part of the circuit board of controller 33. To that end, controller 33 may be configured to receive these signals from the hammer, anvil, and gyroscopic sensor to determine the angular velocity of the hammer and/or anvil. And because the anvil, through the connected output drive, is connected to the fastener or bolt, the rotational velocity of the fastener or bolt can be determined as well.

An accelerometer may be added to the circuit board of controller 33 on impact tool 2 in order to send a signal to controller 33 indicative of an impact between the hammer and anvil. It will be appreciated by a skilled artisan that the accelerometer may be mounted anywhere inside the tool housing in proximity to the impact mechanism. The shock wave created by the impact action of the mechanism is transmitted within the housing and creates a detectable spike in the output of the accelerometer. This signal may be used by the controller as an indication that an impact has occurred.

A motor current transducer sensor may be added to the circuit board of controller 33 and configured to send an input signal to controller 33. Motor current is proportional to motor torque and can be used to determine how much torque is being delivered to the gearing and impact mechanisms. Controller 33, whether located on impact tool 2 or spaced apart, is contemplated to be configured to include storage for these signals received from such detectors.

Impact tool 2 may include a user interface that includes a display, push buttons, audible notifications, and/or LED lighting, for example, to allow adjustment of the functional settings for the impact tool. A selector switch may be attached to impact tool 2 in order to allow individual socket size setting. Further, strain gages may be attached to the anvil to measure torque of same.

Figure 4:
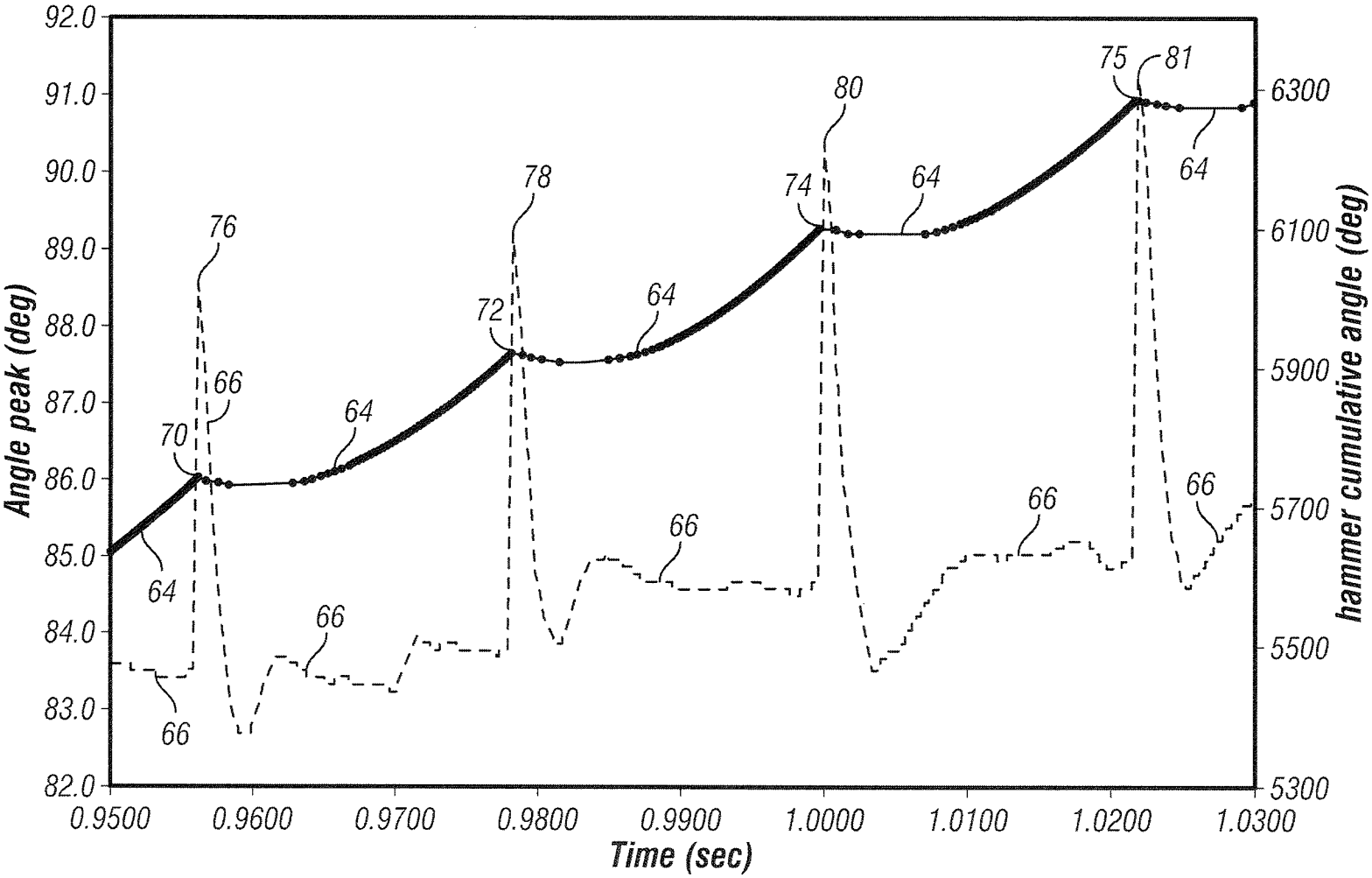
FIG. 4 is a chart depicting cumulative hammer and anvil angle versus time.

A graph of the hammer angle signal 64 and anvil angle signal 66 values plotted against time is shown in FIG. 4. Angle is represented in units of radians on the Y axis and time is represented in units of seconds on the X axis. This trace was produced by the signals from hammer 14 detectors 30, 32, and the anvil signals generated by detectors 36 and 37. Peaks 70, 72, 74, and 75 on lines 64 and 66 represent the impact of jaws 56 and 58 against respective jaw flanges 60 and 62 to rotate anvil 26. As each of markings 82 and 54 pass by the detectors, the value of the angular position read by the controller 33 is incremented. The revised angle reading can be either greater or less than the previous angle value, depending on which direction the component is rotating.

The portion of time represented in FIG. 4, is limited to four impact events. These angle traces were collected while the tool was tightening a fastener which had already been partially tightened. From this graph the behavior and action of anvil 26 and hammer 14 may be studied. The hammer velocity increases until the hammer jaws 56 and 58 engage anvil jaw flanges 60 and 62 to cause anvil 26 to also rotate forward. This sudden connection of rotating hammer 14 to anvil 26 (and connected output drive) constitutes an impact event. Impact events occur twice per revolution of hammer 14. At the point in time when the impact occurs, the anvil angle signal indicates a sudden change from zero velocity to a very high velocity in the forward direction. The sudden acceleration is indicated graphically by the vertical trace, ending in peaks 76, 78, 80, and 81. During the impact, rotational kinetic energy is delivered from hammer 14 to anvil 26 and the connected output drive. Ultimately, the torque is applied to the fastener. The connected output drive includes some rotational elasticity which temporarily stores a portion of the delivered energy which left the hammer. Some of the energy which leaves the hammer is consumed while rotating the fastener. Some energy may be consumed due to losses in the connected output drive. After the torque being delivered by hammer 14 during an impact falls below the level required to continue rotating the fastener, the fastener stops rotating.

After the fastener stops rotating at 76, 78, 80, and 81 the portion of energy temporarily stored in the connected output drive applies a torque to drive the anvil and hammer in the reverse direction 50. Both the hammer and anvil rotate in the reverse direction briefly, until the torque delivered by the motor overcomes the inertia in the hammer and causes it to begin rotating in the forward direction again. This series of steps describe the process of impacting. The anvil and hammer angle signals are sent to controller 33, and can be used to determine many different attributes about the operation of the impact mechanism. Some of the attributes that can be calculated include hammer energy before impact, hammer energy after impact, deflection of the connected output drive, rebound velocity of the connected output drive, and rebound velocity of the hammer. These attributes can be used to calculate the status of bolt torque during the fastening process. Controller 33 can make the decision to stop the motor when a targeted torque has been reached.

Figure 5:
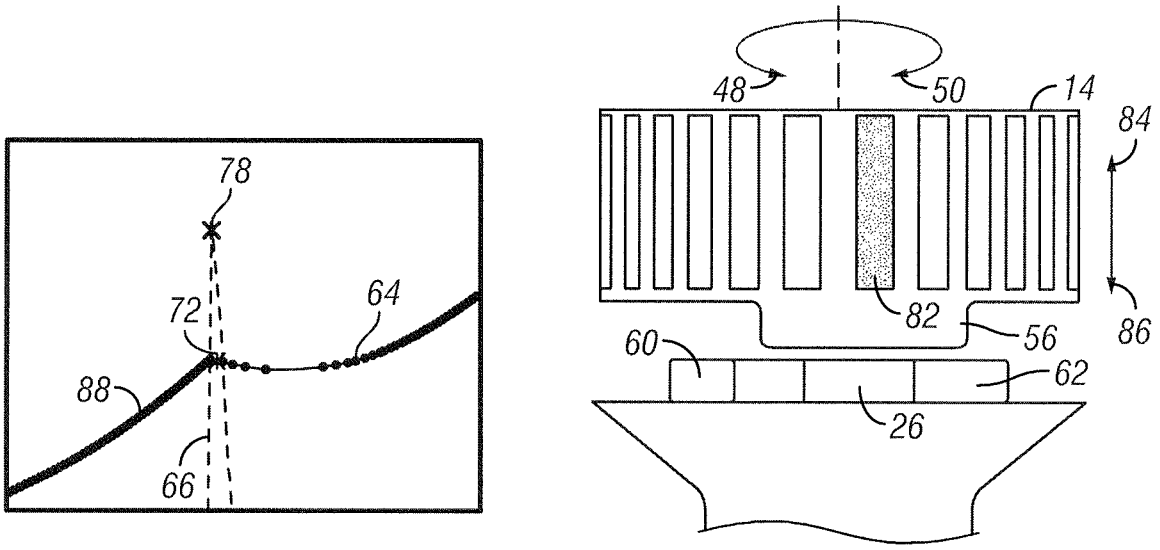
FIG. 5 is a portion of an isolated detailed progression view of the hammer and anvil along with an isolated portion of the chart of FIG. 4.

The isolated detailed views of hammer 14 and anvil 26 engaging in an impact along with the corresponding chart positions from FIG. 4, are shown in the progression views of FIGS. 5, 6, and 7. The view shown in FIG. 5 depicts rotating hammer 14 located at a position just prior to impacting anvil 26. A reference marker 82 is highlighted for demonstrable purposes to allow it to be followed through hammer 14's rotation and impact against anvil 26. As shown in FIG. 5, hammer 14, along with jaw 56 (as well as head 58 not shown in this view) is located above jaw flanges 60 and 62 of anvil 26. The approximate corresponding position of hammer 14 on line 64 from the chart of FIG. 4 is shown at position 88.

Hammer 14 continues rotating illustratively in direction 48 and in direction 86 until, as shown in FIG. 6, jaws 56 and 58 strike jaw flanges 60 and 62, respectively. As can be seen, reference marker 82 has rotated around with hammer 14 in direction 48 and ends up at this location as hammer 14 and anvil 26 impact each other. This position is depicted on the chart at peak 72 on line 64 for hammer 14 and peak 78 on line 66 for anvil 26. After this impact, however, line 64 demonstrates what happens to hammer 14.

As depicted in FIG. 7, reference marker 82 (based on readings from detectors 30 and 32) demonstrates hammer 14 rebounds back in direction 50 opposite of direction 48. Hammer 14 also moves in direction 84 away from anvil 26. The corresponding location on line 64 of the accompanying chart is represented at position 90. As depicted by this chart, the rotational angle of hammer 14 is shown not continuing moving upwards immediately after striking anvil 26. Instead, line 64 moves downwards at 90. After that rebounding period, hammer 14 proceeds again to move upwards corresponding to hammer 14 moving in direction 48 again. As a result, the chart in FIG. 4, and as part of FIGS. 5, 6, and 7, demonstrates that detectors 30 and 32 measure the rebounding effect exhibited by hammer 14.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

The invention claimed is:

1. An impact tool comprising:

an output drive;

an anvil coupled to the output drive, the anvil having an axis of rotation and including an anvil impact surface configured to rotate about the axis of rotation, the anvil impact surface including an outer end positioned radially outward from the axis of rotation;

a hammer configured to apply a rotational impact force on the anvil to rotate the output drive, the hammer including a hammer impact surface configured to engage the anvil impact surface;

a plurality of spaced apart targets located on a surface of the anvil, the surface of the anvil and the plurality of spaced apart targets located radially inward towards the axis of rotation from the outer end of the anvil impact surface;

an anvil angle sensor located proximate to the surface of the anvil, the anvil angle sensor configured to detect respective ones of the plurality of spaced apart targets;

a second plurality of spaced apart targets located on a surface of the hammer;

a hammer angle sensor located proximate to a surface of the hammer, the hammer angle sensor configured to detect respective ones of the second plurality of spaced apart targets; and a controller electrically coupled with the anvil angle sensor and the hammer angle sensor, wherein the anvil angle sensor is configured to generate a first signal in response to detection of one or more of the plurality of spaced apart targets by the anvil angle sensor and the hammer angle sensor is configured to generate a second signal in response to detection of one or more of the second plurality of spaced apart targets by the hammer angle sensor, the first signal and the second signal being furnished to the controller, and wherein the controller determines an attribute associated with operation of one or more of the hammer or the anvil based at least partially on the first signal and the second signal.

2. The impact tool as recited in claim 1, wherein the attribute associated with operation of one or more of the hammer or the anvil includes at least one of an angular position of the hammer, an angular position of the anvil, and angular position of the output drive, an angular velocity of the hammer, an angular velocity of the anvil, an angular velocity of the output drive, an angular kinetic energy in the hammer, and a quantity of energy delivered to the anvil by the hammer.

3. The impact tool as recited in claim 2, further comprising a transmitter configured to wirelessly transmit a signal generated by the controller, the signal containing data indicative of at least one of an angular position of the hammer, an angular position of the anvil, an angular position of the output drive, an angular velocity of the hammer, and angular velocity of the anvil, an angular velocity of the output drive, an angular kinetic energy in the hammer, and a quantity of energy delivered to the anvil by the hammer based at least partially on the first signal and the second signal.

4. The impact tool as recited in claim 2, further comprising a data storage, the data storage configured to store data generated by the controller that is indicative of at least one of an angular position of the hammer, an angular position of the anvil, an angular position of the output drive, an angular velocity of the hammer, an angular velocity of the anvil, an angular velocity of the output drive, an angular kinetic energy in the hammer, and a quantity of energy delivered to the anvil by the hammer based at least partially on the first signal and the second signal.

5. The impact tool as recited in claim 1, further comprising a second anvil angle sensor located proximate to the surface of the anvil and adjacent to the anvil angle sensor, the second anvil angle sensor configured to detect respective ones of the plurality of spaced apart targets.

6. The impact tool as recited in claim 5, wherein the anvil sensor and the second anvil sensor are configured to detect respective ones of the plurality of spaced apart targets to indicate angular movement of the anvil in one or both of a clockwise rotation or a counterclockwise rotation.

7. The impact tool as recited in claim 1, further comprising a transmitter configured to wirelessly transmit a signal generated by the controller, the signal containing data indicative of the attribute associated with operation of one or more of the hammer or the anvil based at least partially on the first signal and the second signal.

8. The impact tool as recited in claim 1, further comprising a data storage, the data storage configured to store data generated by the controller that is indicative of the attribute associated with operation of one or more of the hammer or the anvil based at least partially on the first signal and the second signal.

9. The impact tool as recited in claim 1, further comprising a second hammer angle sensor located proximate to the surface of the hammer and adjacent to the hammer angle sensor, the second hammer angle sensor configured to detect respective ones of the second plurality of spaced apart targets.

10. The impact tool as recited in claim 9, wherein the hammer sensor and the second hammer sensor are configured to detect respective ones of the plurality of spaced apart targets to indicate angular movement of the hammer in one or both of a clockwise rotation or a counterclockwise rotation.

11. The impact tool as recited in claim 1, wherein respective ones of the plurality of spaced apart targets comprises one or more of ferromagnetic markings, capacitive markings, optical indicia, physically detectable markings, and electronically detectable markings.

12. The impact tool as recited in claim 1, further comprising:

a tool housing; and a gyroscopic sensor disposed within the tool housing, wherein the gyroscopic sensor is configured to detect rotation of the tool housing about an axis coincident with the axis of rotation of the anvil.

13. The impact tool as recited in claim 1, further comprising an accelerometer configured to detect an impact between the hammer and the anvil.

14. The impact tool as recited in claim 1, further comprising:

a motor configured to furnish an output torque to the hammer; and a motor sensor configured to detect the output torque furnished by the motor.

15. The impact tool as recited in claim 1, further comprising at least one strain gauge disposed on the anvil, the at least one strain gauge configured to detect a torque generated by the anvil.

16. An impact tool comprising:

an output drive;

an anvil coupled to the output drive, the anvil having an axis of rotation and including an anvil impact surface configured to rotate about the axis of rotation, the anvil impact surface including an outer end positioned radially outward from the axis of rotation;

a hammer configured to apply a rotational impact force on the anvil to rotate the output drive, the hammer including a hammer impact surface configured to engage the anvil impact surface;

a first plurality of spaced apart targets located on a surface of the anvil, the surface of the anvil and the plurality of spaced apart targets located radially inward towards the axis of rotation from the outer end of the anvil impact surface;

an anvil angle sensor located proximate to the surface of the anvil, the anvil angle sensor configured to detect respective ones of the plurality of spaced apart targets and to generate a first signal in response thereto;

a second plurality of spaced apart targets located on a surface of the hammer;

a hammer angle sensor located proximate to a surface of the hammer, the hammer angle sensor configured to detect respective ones of the second plurality of spaced apart targets and to generate a second signal in response thereto; and a controller electrically coupled with the anvil angle sensor and the hammer angle sensor and configured to receive the first signal and the second signal, wherein the controller determines an attribute associated with operation of one or more of the hammer or the anvil based at least partially on the first signal and the second signal.

17. The impact tool as recited in claim 16, further comprising a second anvil angle sensor located proximate to the surface of the anvil and adjacent to the anvil angle sensor, the second anvil angle sensor configured to detect respective ones of the first plurality of spaced apart targets and to generate a third signal in response thereto; and a second hammer angle sensor located proximate to the surface of the hammer and adjacent to the hammer angle sensor, the second hammer angle sensor configured to detect respective ones of the second plurality of spaced apart targets and to generate a fourth signal in response thereto, the third signal and the fourth signal being furnished to the controller, wherein the controller determines at least one of an angular position of the hammer, an angular position of the anvil, an angular position of the output drive, an angular velocity of the hammer, an angular velocity of the anvil, an angular velocity of the output drive, an angular kinetic energy in the hammer, and a quantity of energy delivered to the anvil by the hammer based at least partially on the third signal and the fourth signal.

* * * * *